United States Patent [19]

Ray

[11] Patent Number: 4,813,252

[45] Date of Patent: Mar. 21, 1989

[54] LOCKING DEVICE FOR FIREARMS

[76] Inventor: Donald R. Ray, 7000 Palmetto Ct., Bakersfield, Calif. 93309

[21] Appl. No.: 95,030

[22] Filed: Sep. 10, 1987

[51] Int. Cl.[4] ..... E05B 73/00

[52] U.S. Cl. ..... 70/18; 70/58

[58] Field of Search ..... 70/18, 15, 14, 57, 58, 70/59, 61, 62; 248/551, 552, 553; 211/4, 8

[56] References Cited

U.S. PATENT DOCUMENTS

| | | | |
|---|---|---|---|
| 1,800,943 | 4/1931 | Junkunc | 70/18 |
| 3,834,196 | 9/1974 | Stone | 70/18 |
| 3,838,585 | 10/1974 | Foote | 70/18 |
| 3,908,414 | 9/1975 | Thorne | 70/18 |

FOREIGN PATENT DOCUMENTS

| | | | |
|---|---|---|---|
| 312126 | 5/1919 | Fed. Rep. of Germany | 70/18 |

*Primary Examiner*—Robert L. Wolfe

*Attorney, Agent, or Firm*—Charles C. Logan, II

[57] ABSTRACT

A locking device for firearms that allows the firearms to be openly displayed, yet safe from the hands of inquisitive children. The device is formed from an elongated rod member that has been formed into an open loop configuration whose free ends are directed toward each other and have a predetermined open space between their tips. The rod member is inserted into the eyelet portion of an eyebolt that has been threaded into a corner stud of a room. Two portions of the open loop configuration of the rod member are oriented at 90 degree angles to each other and these aligned horizontally and in mating relationship to the respective corner walls to which the eyebolt has been secured. Either of the free ends of the rod member is threaded through the trigger guard of a rifle or revolver to secure the firearm to the locking device. A variety of quick release latching structures are avaliable for closing the open space of the open loop configuration and each of these have at least one sliding tubular sleeve that has aligned laterally oriented apertures therein, through which the U-shaped bar of a padlock may be inserted and which therefore prevents removal of the firearms from the locking device. The rod member is made of case hardened steel as would be the U-shaped bar of the padlock. When at least one rifle has been secured by the locking device, it is impossible for the eyebolt to be unthreaded and it would take a tremendous amount of pulling force to separate the eyebolt from the stud located in the corner of the room.

9 Claims, 4 Drawing Sheets

LOCKING DEVICE FOR FIREARMS

BACKGROUND OF THE INVENTION

The invention relates to a locking device and more specifically for a device to secure firearms in a person's home or office so that they cannot be played with by children.

In the past there have been numerous occasions when children have taken a parents firearm such as a revolver or rifle and while using or examining it they have injured or killed another human being. Many people keep revolvers in open drawers and merely hope that children will not find them and therefore not play with them. Other persons having rifles have been forced to purchase or build expensive gun racks or cabinets that require locks of some nature. Some of these cabinets have glass windows in them which leaves them open to the danger of having the glass broken and a person reaching into the cabinet and obtaining the weapon.

It is an object of the invention to provide a novel locking device for firearms that will safely secure rifles and revolvers in an open setting within a room of a house of office.

It is also an object of the invention to provide a novel locking device for firearms that allows them to be visually in view yet secure from the curious hands of children.

It is another object of the invention to provide a novel locking device for firearms that is economical to manufacture and market.

It is a further object of the invention to provide a novel locking device for firearms that would make it extremely difficult for an adult to remove or steal a firearm from the locking device unless they destroyed a portion of the walls of the room adjacent to where the locking device is secured.

SUMMARY OF THE INVENTION

Applicant's novel locking device for firearms have been designed to prevent accidents to children caused by their having obtained a parent or neighbor's gun that had not been properly secured.

The locking device allows the owner to display his firearms openly in a room in his house or office without the need for an expensive closed cabinet for storing them. The novel locking device makes use of the structural integrity of the walls of a room, most especially the vertical stud that is located adjacent the corner of a room. An eyebolt is screwed into the corner stud at a predetermined height above the base upon which the butt of the rifles would be resting. The eyebolt would be screwed in to the stud to a point where only ¼ of a turn is still possible at this point and the eyelet portion would be oriented horizontally. The elongated rod member that has been formed into an open loop configuration would then have one of its free ends threaded down through the eyelet portion and that last ¼ turn of rotation would be made to the eyebolt. At this point the two primary portions of the open loop configuration would be oriented parallel to the respective corner walls of the room and the locking device would extend outwardly from the corner in a horizontal plane. Spaced upwardly a predetermined height above the rod member having the open loop configuration would be a barrel loom that would have side walls oriented 90 degrees to each other so that it would fit snugly into the corner of the room also. The front wall of the barrel loom has a plurality of concave notches that matingly receive the gun barrels of the rifles to be secured.

The manner of securing the rifles and revolvers to the locking device requires that each of them have one of the free ends of the rod member inserted through the firearms trigger guard. For rifles not having a permanently closed and rigid trigger guard a stock lock would be utilized which would prevent the firearm from being slipped upwardly or downwardly from the locking device.

The structure for closing the open space between the ends of the rod members open loop configuration may take the form of various types of quick release latching structure. All of these however, utilize a sliding tubular member that telescopes over the free ends of the rod member and a sliding member must have aligned laterally oriented apertures therein which allow the U-shaped bar of a padlock to be inserted through the aligned apertures and thus prevent lateral movement of the sliding tubular member and thus prevent removal of firearms from the locking device.

DESCRIPTION OF THE PREFERRED EMBODIMENT

Figure 1:
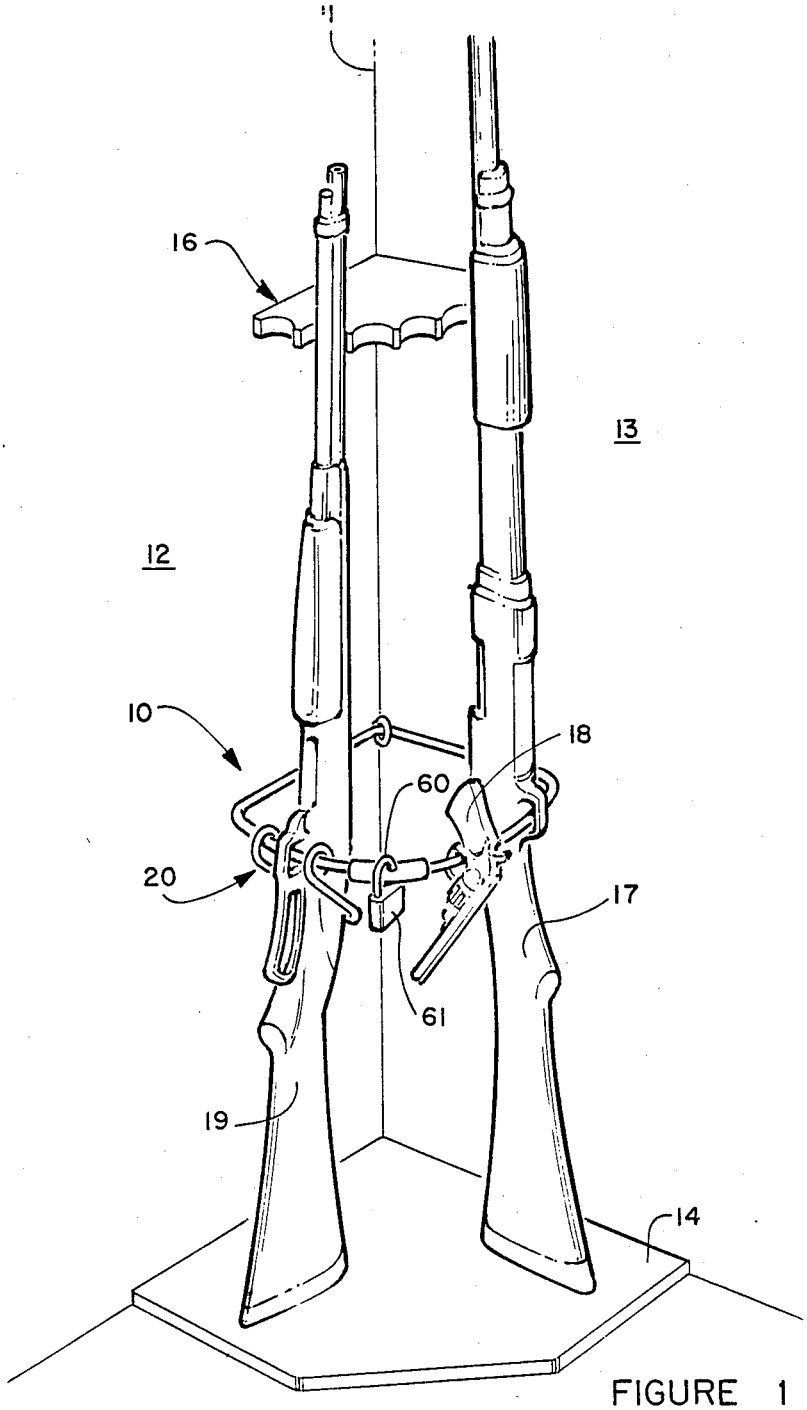
FIG. 1 is a perspective view illustrating Applicant's novel locking device for firearms as it is positioned in a corner of a room.
Figure 4:
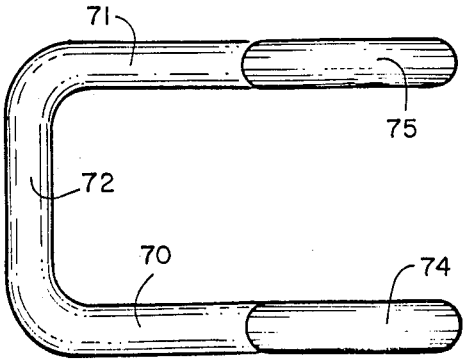
FIG. 4 is a top plan view of a stock lock utilized with the locking device for firearms.
Figure 5:
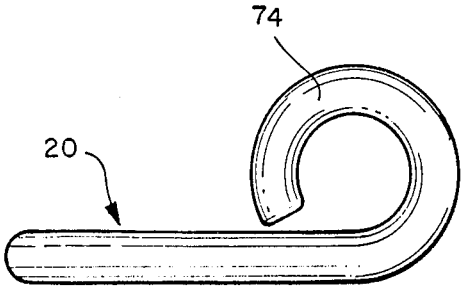
FIG. 5 is a side elevation view of the stock lock.

Applicant's novel locking device for firearms will now be described by referring to FIG. 1–9 of the drawings. The locking device is generally designated numeral 10. As seen in FIG. 1 locking device 10 is secured to the corner 11 of side walls 12 and 13. A base pad 14 is positioned a predetermined height below the locking device 10. A barrel loom **16*b* is positioned a predetermined height above the locking device 10. A rifle 17, a revolver 18, and a pump action rifle 19 are illustrated as being secured by the locking device 10. A stock lock 20** is utilized with the pump action rifle.

Figure 2:
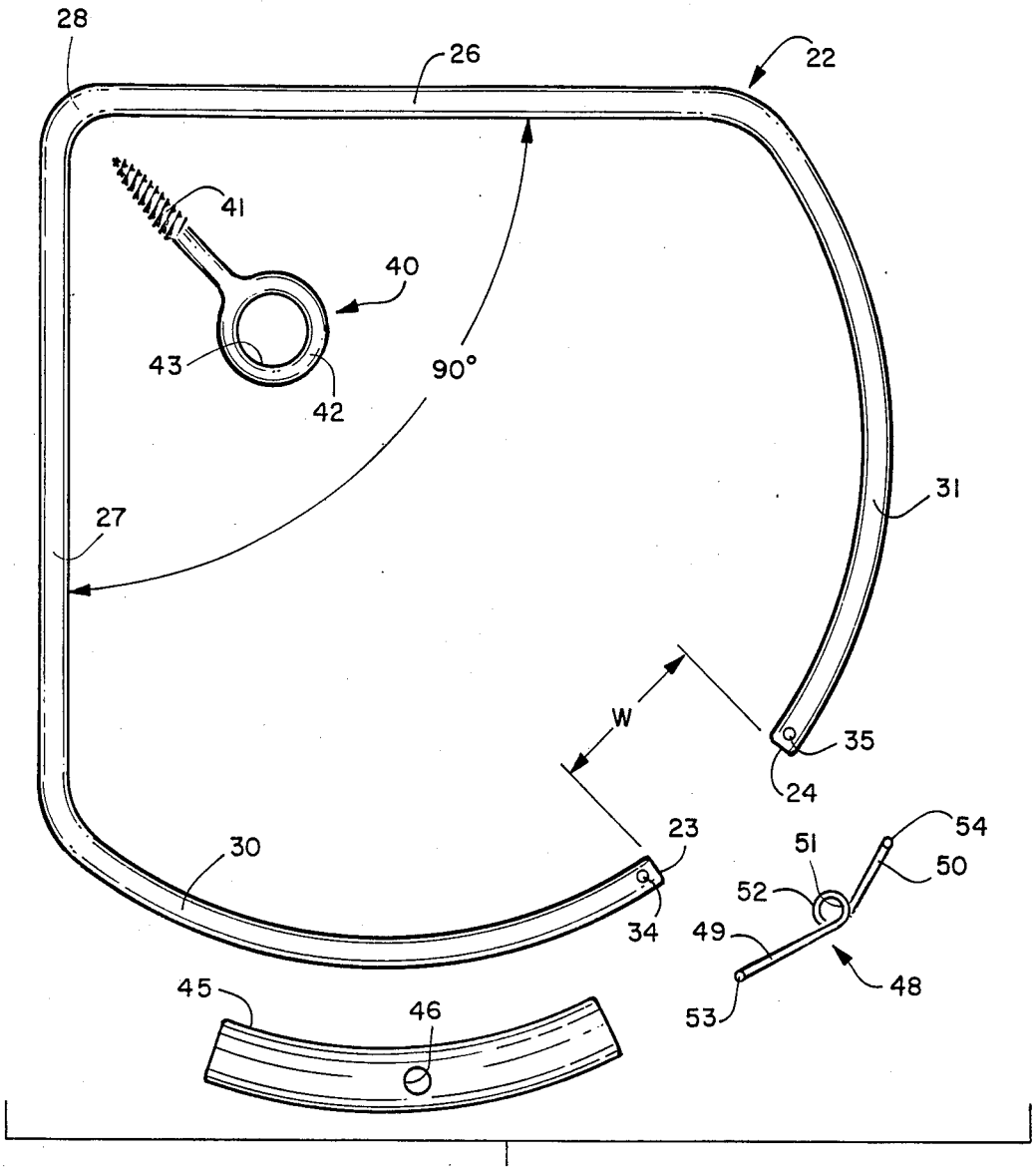
FIG. 2 is a top plan exploded view of applicant's novel locking device for firearms.
Figure 3:
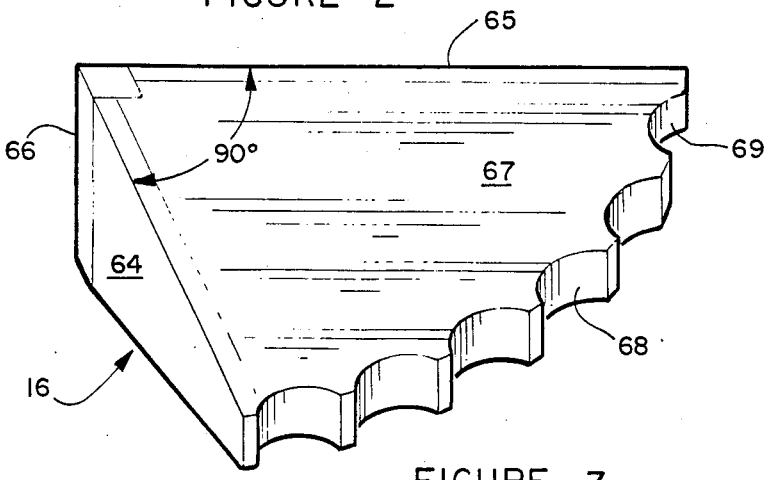
FIG. 3 is a front perspective view of the barrel loom utilized as a component of the locking device for firearms.

The locking device 10 that is utilized in FIG. 1 is best described by referring to FIG. 2. It is formed from a rod member 22 that has been formed into an open loop configuration having a predetermined open space W between tips 23 and 24. Rod member 22 is formed from a pair of primary portions 26 and 27 that are oriented substantially 90 degrees to each other and have a corner 28 where they meet. Curved arm portions 30 and 31 extend from the respective primary portions. Laterally oriented apertures 34 and 35 are formed adjacent the respective tips 23 and 24. The eyebolt 40 has a threaded shank 41 and an eyelet portion 42 having an aperture 43 therein. A sliding tubular member 45 has aligned laterally oriented apertures 46 in its top and bottom surface. Keeper member 48 has a pair of arm portions 49 and 50 that extend away from each other and which have a looped coil portion 51 therebetween which has an aperture 51 in its middle. Legs 53 and 54 extend downwardly from the respective arm portions 49 and 50. Once all of the firearms have had their triggerguard structure inserted over the tips 23 or 24 of the rod member, keeper member would have its legs 53 and 54 inserted into the respective apertures 34 and 35. Then the sliding tubular member 45 which already would have been on one of the curved arm portions 30 or 31, would be slid laterally until it's apertures 46 would align with aperture 51 of the keeper member 48. At this point the U-shaped bar 60 of padlock 61 would be inserted through the aligned apertures and the padlock is secured. Since the rod member 22 is formed of case hardened steel and the U-shaped bar 60 of the padlock would also be formed of case hardened steel, it would not be possible to saw through either of these two members in order to remove any of the firearms.

Barrel loom 16 is illustrated as having a pair of vertically oriented side walls 64 and 65 that are oriented at substantially 90 degrees to each other and forming a corner 66 thereat. It has a top wall 67 and a front wall 68 that has a plurality of concave notches 69 formed therein for mating with the gun barrels of the rifles.

The stock lock 20 has a pair of laterally spaced legs 70 and 71 that are connected at one of their ends by a cross member 72. The opposite ends of legs 70 and 71 have curved loop tips 74 and 75. Each curled loop tip has an aperture which allows them to be threaded onto one of the curved arm portions 30 or 31.

Figure 7:
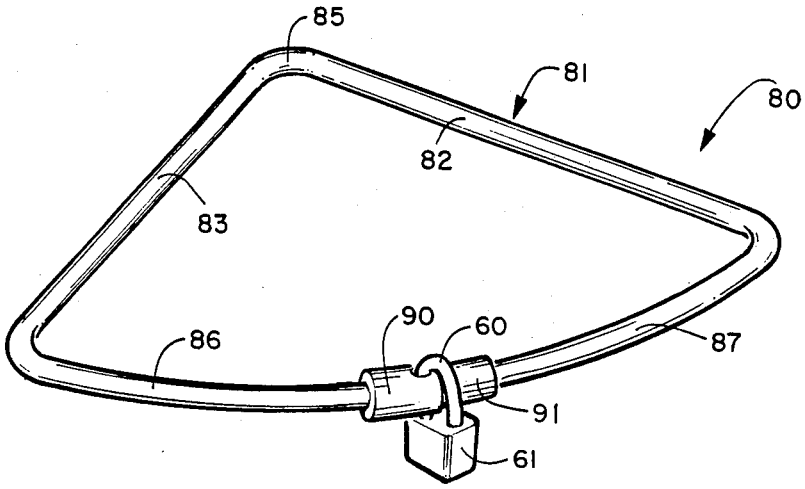
FIG. 7 is a front perspective view illustrating a first alternative embodiment of the locking device for firearms.
Figure 8:
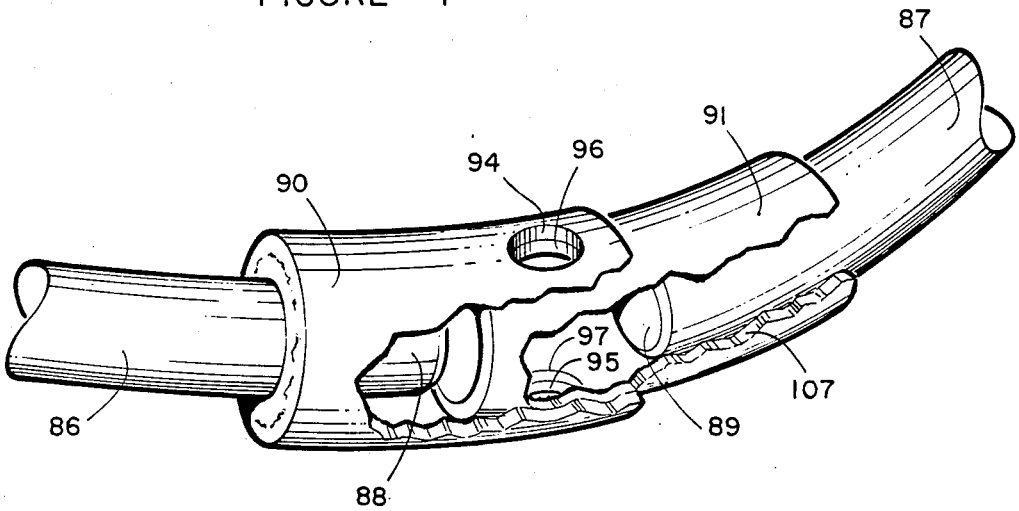
FIG. 8 is a perspective view with portions broken away of the quick release latching structure illustrated in FIG. 7.
Figure 6:
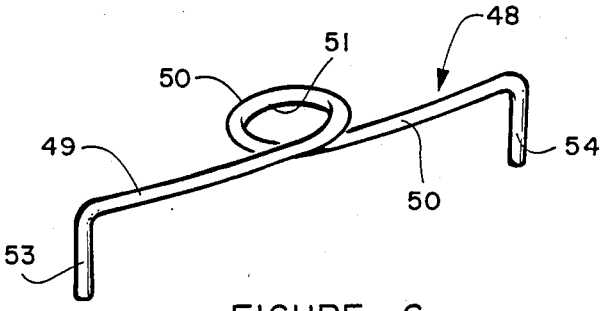
FIG. 6 is a perspective of the keeper member illustrated in FIG. 2.

A second embodiment of the locking device for firearms is illustrated in FIGS. 7 and 8 and is generally designated by numeral 80. Rod member 81 has primary portions 82 and 83 that intersect each other at substantially 90 degrees at corner 85. Curved arm portions 86 and 87 would also have a predetermined open space W between their tips 88 and 89 respectively. The quick release latching structure of this embodiment has a primary tubular sleeve 90 and a secondary tubular sleeve 91. These tubular sleeves telescope together when in their locked position and can be slid in opposite directions in order to remove any of the firearms or insert them on the rod member 81. Primary tubular sleeve 90 has laterally oriented apertures 94 and 95 in it's opposite walls. Likewise, secondary tubular sleeve 91 has laterally oriented apertures 96 and 97 in its opposite walls. By aligning these 4 respective within the open space W, the U-shaped bar 60 of a padlock can be inserted therethrough and the padlock secured.

Figure 9:
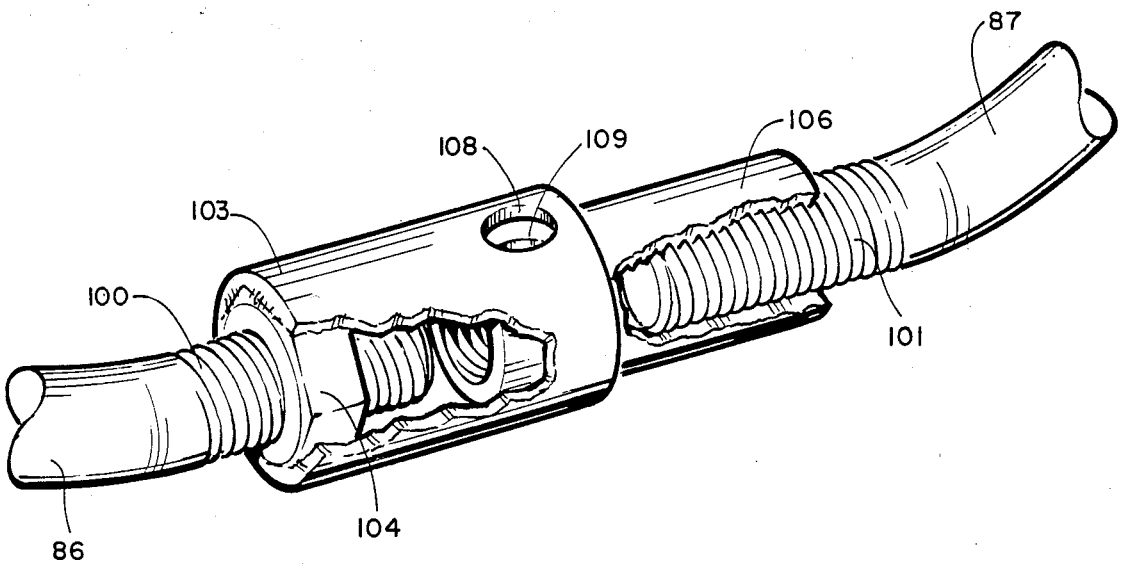
FIG. 9 is a perspective view with portions broken away of an alternative quick release latching structure for the embodiment illustrated in FIG. 7.

An alternative quick release latching structure, for the embodiment illustrated in FIG. 7 is seen in FIG. 9. The tips of curved arm portions 86 and 87 have external threads 100 and 101 respectively. These external threads may be right screw threads or left hand screw threads as long as they are both the same. Primary tubular sleeve 103 has a nut 104 welded in its bore. This allows primary tubular sleeve 103 to be screwed forwardly and rearwardly on the tip of curved arm portion 86. Secondary tubular sleeve 106 has internal threads 107 allowing it to be threaded forwardly and rearwardly on the tip of curved arm portion 87. Primary tubular sleeve 103 and secondary tubular sleeve 106 telescope together and they have laterally oriented apertures 108 and 109 in their respective opposite walls. By aligning these four apertures the U-shaped bar 60 of the padlock 61 can be quickly inserted therethrough and the padlock secured.

What is claimed is:

1. A locking device for securing firearms to a corner stud of a room comprising:

an elongated member formed into an open loop configuration having a pair of primary portions that intersect each other at substantially ninety degrees to form a corner, the opposite ends of the primary portions have arm portions whose free ends are directed toward each other and have a predetermined open space W between their tips;

quick release latching means for closing said open space W so that a closed loop is formed and firearms that have been secured by the locking device cannot be removed by unauthorized persons;

an eyebolt having a threaded shank and an eyelet portion having an aperture therein, said threaded shank being screwed into the corner stud of the room; and said eyebolt and elongated member being connected together by threading said elongated member through the eyelet portion of said eyebolt.

2. A locking device for firearms as recited in claim 1 wherein said elongated member is formed of rod shaped material.

3. A locking device for firearms as recited in claim 2 wherein said rod shaped material is case hardened steel.

4. A locking device for firearms as recited in claim 1 further comprising a barrel loom having a top wall, a bottom wall, a pair of vertical side walls that intersect each other at substantially ninety degrees to form a corner that is secured to the corner of the room at a predetermined height above said eyebolt, said barrel loom having a front wall having a plurality of concave notches formed in its face to receive the gun barrel of a rifle secured by said locking device.

5. A locking device for firearms as recited in claim 1 further comprising at least one stock lock formed from an integral length of rod that has been bent into a shape having a pair of laterally spaced legs that have their one end connected together by a cross member and whose other ends have curved loop tips formed on them and one of the arm portions of said elongated member has its free end threaded through the central apertures formed in said closed loop tips so that said stock lock can be used to secure rifles having movable trigger guards to said locking device.

6. A locking device for securing firearms to a corner stud of a room comprising:

an elongated member formed into an open loop configuration having a pair of primary portions that intersect each other at substantially ninety degrees to form a corner, the opposite ends of the primary portions have arm portions whose three ends are directed toward each other and have a predetermined open space W between their tips, the arm portiosn of said elongated member that extend toward each other have an arcuate curvature; and quick release latching means for closing said open space W so that a closed loop is formed and firearms that have been secured by the locking device cannot be removed by unauthorized persons.

7. A locking device for securing firearms to a corner stud of a room comprising:

an elongated member formed into an open loop configuration having a pair of primary portios that intersect each other at substantially ninety degrees to form a corner, the opposite ends of the primary portions have arm portions whose free ends are directed toward each other and have a predetermined open space W between their tips;

quick release latching means for closing said open space W so that a closed loop is formed and firearms that have been secured by the locking device cannot be removed by unauthorized persons comprising laterally oriented apertures adjacent the tips of the arm portions of said elongated member, a keeper member and a sliding tubular member;

said keeper member having a pair of arm portions that extend in opposite directions from each other and are connected to each other by a looped coiled portion having an aperture into which the U-shaped bar of a padlock is inserted, the free ends of said arm portions having downwardly extending legs that are detachably received in said respective laterally oriented apertures adjacent the tips of the arm portions of said elongated member;

said sliding tubular member having an inside diameter greater than the outside diameter of said elongated member so that it can be slid thereover, the length of said sliding tubular member being greater than the open space W, aligned laterally oriented apertures in said sliding tubular member which when aligned with the aperture in said keeper member allows the U-shaped bar of the padlock to be inserted through the aligned apertures and then prevent removal of the firearms from the locking device.

8. A locking device for securing firearms to a corner stud of a room comprising:

an elongated member formed into an open looped configuration having a pair of primary portions that intersect each other at substantially ninety degrees to form a corner, the opposite ends of the primary portions have arm portions whose free ends are directed toward each other and have a predetermined open space W between their tips;

quick release latching means for closing said open space W so that a closed loop is formed and firearms that have been secured by the locking device cannot be removed by unauthorized persons comprising a primary tubular sleeve that telescopes over a secondary tubular sleeve and both of these sleeves have an inner diameter great enough to telescope over the arm portions of said elongated member;

said primary tubular sleeve and said secondary tubular sleeve each having a pair of aligned laterally oriented apertures which when aligned allows the U-shaped bar of the padlock to be inserted through the four aligned apertures and thus prevent removal of the firearms from the locking device.

9. A locking device for securing firearms to a corner stud of a room comprising:

an elongated member formed into an open loop configuration having a pair of primary portions that intersect each other at substantially ninety degrees to form a corner, the opposite ends of the primary portions have arm portions whose free ends are directed toward each other and have a predetermined open space W between their tips;

quick release latching means for closing said open space W so that a closed loop is formed and firearms that have been secured by the locking device cannot be removed by unauthorized persons comprising a primary tubular sleeve that telescopes over a secondary tubular sleeve, the free ends of the arm portions of said loop configuration are externally threaded and the respective primary and secondary tubular sleeves having mating internally threaded structure that can be screwed on to these threaded free ends;

said primary tubular sleeve and said secondary tubular sleeve each having a pair of aligned laterally oriented apertures which when aligned allows the U-shaped bar of the padlock to be inserted through the four aligned apertures and thus prevent removal of the firearms from the locking device.

* * * * *